US005377752A

United States Patent [19]

Farrara

[11] Patent Number: 5,377,752

[45] Date of Patent: Jan. 3, 1995

[54] GUARD DEVICE

[75] Inventor: Robert N. Farrara, Hoosick Falls, N.Y.

[73] Assignee: Campbell Mfg. Inc., Pa.

[21] Appl. No.: 214,546

[22] Filed: Mar. 18, 1994

[51] Int. Cl.[6] ..... E21B 17/00

[52] U.S. Cl. ..... 166/241.6

[58] Field of Search ..... 166/241.1, 241.2, 241.4, 166/241.6, 241.7

[56] References Cited

U.S. PATENT DOCUMENTS 3,933,203 1/1976 Evans ..... 166/241.6
4,306,620 12/1981 Fronius ..... 166/241.6
4,483,395 11/1984 Kramer et al. ..... 166/241.6

*Primary Examiner*—Michael Powell Buiz
*Attorney, Agent, or Firm*—Herman H. Bains

[57] ABSTRACT

A guard device for use with a drop pipe in a well casing includes a pair of similar guard sections each being formed of a plastic material. Each section includes inner and outer arcuate members interconnected by ribs and plates. The inner arcuate member of each section engages the drop pipe and the outer arcuate member has tabs which engage the well casing to enter the drop pipe. A locking member on each section interlocks with a lock engaging member on the other section. Vertical passages through the sections accommodate electrical conductors, safety ropes and similar components to thereby minimize damage to these components.

7 Claims, 1 Drawing Sheet

GUARD DEVICE

BACKGROUND OF THE INVENTION

1. Field of the Invention

This invention relates to a guard device for use with drop pipes in well casings.

2. Discussion of the Prior Art

In conventional wells, the drop pipe is positioned within a well casing and a pump is attached to the lower end of the drop pipe. Electrical conductors, a safety rope, cables are connected to the pipe within the well casing and extend upwardly therethrough. If the drop pipe, cables, ropes and electrical conductors are suspended within the cable from the top, the drop pipe and these other components may engage the inner wall surface of the casing may be damaged by abrasive interaction with the well casing.

Guard devices have been developed for preventing such damage including U.S. Pat. No. 3,933,203 which must be strung over the end of the drop pipe section during installation.

U.S. Pat. No. 4,403,395 discloses a single piece hinged guard device which may be releasably applied to a drop pipe. This patent is owned by the same assignee of the present application.

SUMMARY OF THE INVENTION

It is an object of this invention to provide a guard device for wells comprised of a pair of similar sections which are releasably locked together to engage and position a drop pipe in spaced relation within a well casing to provide passages for electrical conductors, safety ropes or cables attached to a pump located at the bottom of the drop pipe.

The guard device includes a pair of substantially identical plastic sections each including an inner arcuate pipe engaging member and an outer arcuate member. The outer arcuate member for each section has a plurality of tabs integral therewith which extend outwardly therefrom to engage the inner surface of the well casing. Each section includes a locking member and a lock engaging member. The locking member on one section engages the lock engaging member on the other section to releasably lock the sections together in engaging relation with the drop pipe to maintain the drop pipe in spaced relation with respect to the casing. Each section also has at least one vertically disposed passage therein between the inner and outer arcuate members for accommodating electrical conductors, safety ropes and similar components.

DESCRIPTION OF THE PREFERRED EMBODIMENT

Figure 1:
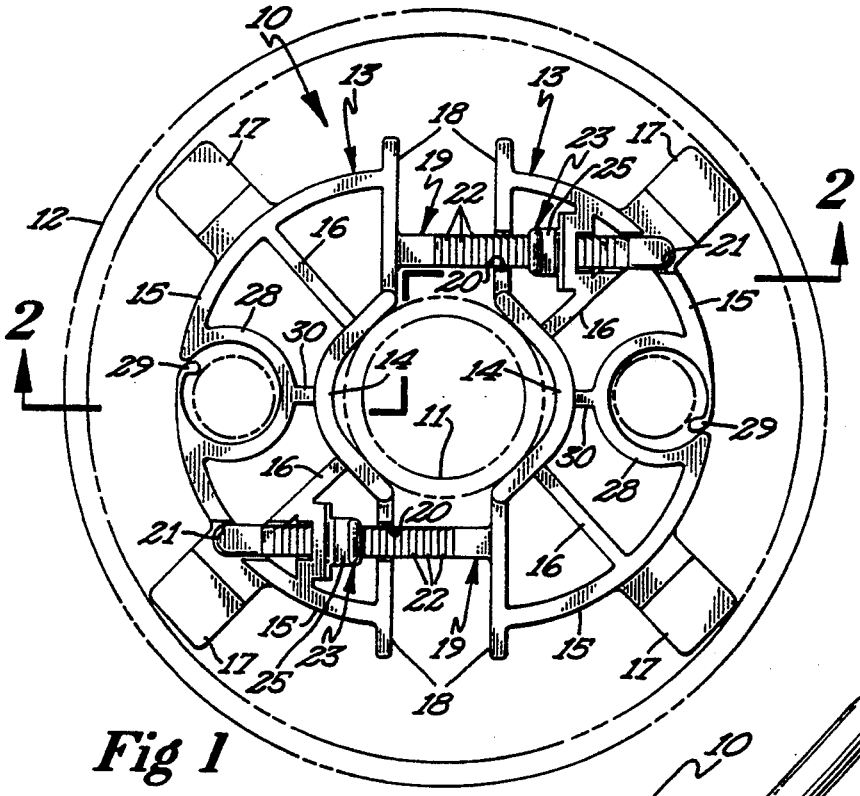
FIG. 1 is a top plan view of the guard device in engaging relation with a drop pipe and with a well casing.

Referring now to the drawings, it will be seen that one embodiment of the novel guard device, designated generally by the reference numeral 10, is thereshown. The guard device 10 is formed of a molded plastic material and when used engages a conventional drop pipe 11 positioned within a well casing 12. It is pointed out that the drop pipe 11 extends vertically downwardly within the casing 12 and is connected to a pump at its lower end in the conventional manner. The well casing 12 projects upwardly to the surface while the drop pipe is connected to a lateral delivery pipe in a well known manner. Although all of these well features are not disclosed in the drawings, the features are well illustrated in U.S. Pat. No. 4,483,395 and are incorporated by reference herein.

The guard device 10 is comprised of a pair of substantially identical guard device sections 13 each including an inner arcuate pipe engaging member 14 and an outer arcuate member 15 interconnected to the inner arcuate member by suitable ribs 16.

Figure 2:
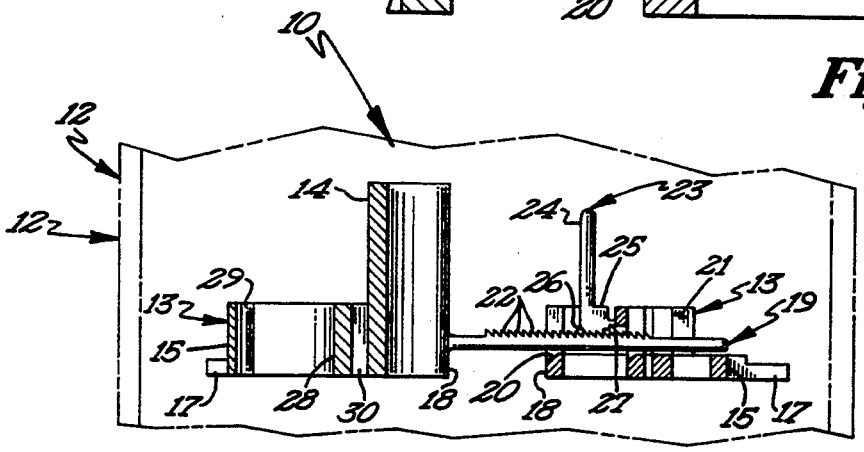
FIG. 2 is a side elevational view of the guard device secured to a drop pipe and engaging the well casing.

The outer arcuate member 15 for each section 13 has a pair of outwardly extending tabs 17 integrally formed therewith and projecting outwardly therefrom. It will be seen that each tab 17 engages the inner surface of the well casing when the guard device is applied to a drop bucket. It will also be seen that each end of the inner arcuate pipe engaging member 14 is connected to the adjacent end of the outer arcuate member by one of a pair of interconnecting plates 18, as best seen in FIG. 2. The plates 18 rib 16 and outer arcuate member 15 all have substantially identical vertical or axial dimensions, and these dimensions are substantially smaller than the vertical or axial dimension of the inner arcuate pipe engaging member 14.

One of the interconnecting plates 18 for each section 13 has an elongate substantially straight locking member 19 integrally formed therewith and projecting outwardly therefrom. The other interlocking plate 18 of each section 13 has a notch or slot 20 therein of a size to accommodate the locking member 19 therethrough. It will also be noted that the outer arcuate member 15 of each section has a slot or notch 21 therein and that the adjacent rib 16 is recessed to accommodate the locking member 19 from the adjacent section 13. The upper surface of each locking member has a plurality of upwardly facing serrations or teeth 22 formed thereon intermediate the ends thereof.

Figure 3:
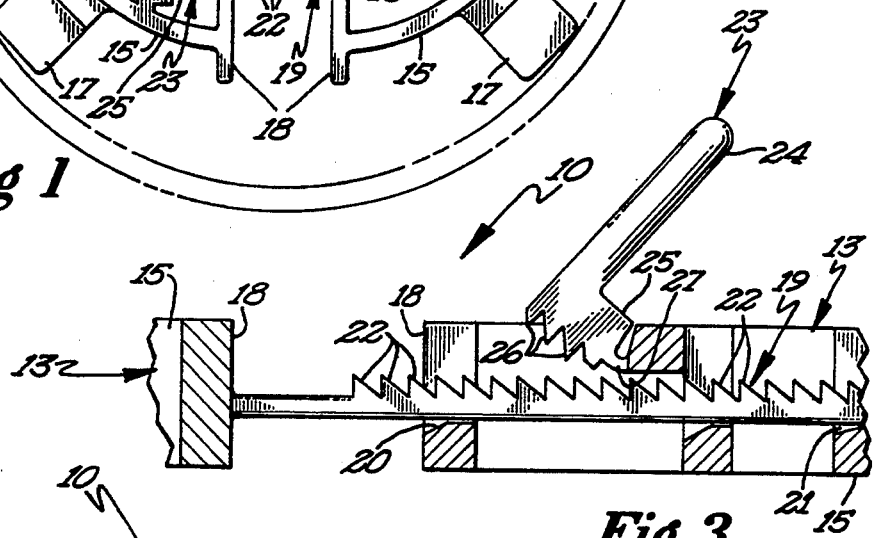
FIG. 3 is a cross-sectional view illustrating the locking member on one section and a lock engaging member on the other.

Each section 13 is also provided with a lock engaging member 23 which is integral with the recessed rib and with the outer arcuate member 15. Referring now to FIG. 3, it will be seen that each lock engaging member 23 includes an elongate upwardly projecting handle or thumb tab 24 which is connected at its lower end to a lock engaging lower portion 25 disposed at right angles to the handle 24. It will be seen that the lock engaging lower portion 25 has a plurality of downwardly extending teeth 26 formed along a portion of its lower surface for engagement with the teeth or serations 22 on one of the locking members 19. The lock engaging lower portion 25 is also relieved or recessed intermediate its length to form a hinge 27 to permit vertical flexing movement of the lock engaging member.

Each section 13 also has a cylindrical element 28 integrally formed with the outer arcuate member 15 intermediate the ends of the latter. Each cylindrical element 28 has a vertically extending mold-in opening 29 therein and is interconnected with the adjacent inner arcuate member 14 by a small rib 30. The cylindrical element 28 also has a vertical dimension corresponding to the vertical dimension of the outer arcuate member. The opening 29 in the cylindrical element 28 permits an electrical conductor or safety rope to be moved through the opening and positioned within the cylindrical element. The enlarged end portion 31 of the cylindrical member adjacent the opening 29 resists accidental dislodgment conductor through the opening 29.

In use, the sections 13 will be positioned in opposed relation with each other and will be urged towards each other so that the locking members 19 will pass through the slots 20, 21 on the opposite section the lock engaging members 23 will be flexed to the open position to allow movement of the locking members 19 past the lock engaging members 23. The sections will continue to be urged towards each other until the inner arcuate pipe engaging member engages the pipe and with the interconnecting plates on the respective sections being disposed in closely spaced confronting relation. The lock engaging members 23 will be released to lock the sections 13 together and to the drop pipe 11. When guard devices are applied to a drop pipe along the length of the latter, the electrical conductors, ropes and other elements connected to the pump will be spaced inwardly of the casing 12 since the tabs 17 will engage the inner surface of the casing. The pipe 11 will be substantially centered and will be held against abrasive engagement with the well casing.

The guard device 10 may be readily applied to drop pipes 11 of conventional size without requiring any tools and will retain the drop pipe in centered relation within the casing while retaining the safety rope and electrical conductors within the confines of the guard device.

It will therefore be seen that I have provided a novel guard device for use with drop pipes located within well casings which guard device functions to substantially center the drop pipe while preventing damage to the drop pipe safety ropes, electrical conductors and other components by abrasive action with the well casing.

What is claimed is:

1. A plastic guard device for use with a drop pipe positioned in a well casing having a pump attached to the lower end of the drop pipe, comprising;

a pair of similar guard sections disposed in opposing relation and including an inner arcuate pipe engaging member and an outer arcuate member spaced outwardly of the inner arcuate member, a plurality of outwardly extending tabs on the outer arcuate member and a plurality of ribs interconnecting the inner and outer arcuate members of each section, means on each section defining a vertical passage through which electrical conductors, safety ropes and similar components may pass;

each section including an elongate locking member and a lock engaging member, each locking member on one section engaging the lock engaging member on the other section to releasably interlock said sections together so that the inner arcuate members engage the drop pipe and the tabs on the outer arcuate members engage the well casing to thereby retain the drop pipe, electrical conductors and safety ropes in spaced relation with respect to the well casing.

2. The guard device as defined in claim 1 wherein each section includes a pair of substantially flat plate elements each interconnecting one end of the inner arcuate member with an adjacent end of the outer arcuate member, each plate being disposed in confronting relation with a plate on the other section when said sections are interconnected together in engaging relation with a drop pipe.

3. The guard device as defined in claim 2 wherein each locking member is integral with one of said plate elements and projects outwardly therefrom.

4. The guard device as defined in claim 3 wherein the other plate element of each section is slotted for receiving a locking member therethrough, each locking engaging member located adjacent the slotted plate element.

5. The guard device as defined in claim 1 wherein each locking member and each locking engaging member has serrations thereon, the serrations on each locking member interlocking with the serrations on the associated lock engaging member.

6. The guard device as defined in claim 5 wherein each lock engaging member is of generally L-shaped configuration including an upstanding actuating handle and a lock engaging element for engaging a locking member.

7. The guard device as defined in claim 6 wherein each lock engaging element is relieved to define a hinge element to facilitate movement of each lock engaging member into and out of engaging relations with each locking member.

* * * * *